US006346039B2

(12) United States Patent
Orton et al.

(10) Patent No.: US 6,346,039 B2
(45) **Date of Patent: *Feb. 12, 2002**

(54) COIN CHANGER

(75) Inventors: David Orton, West Yorkshire; Malcolm Reginald Hallas Bell, Leeds; Paul Ashford; Gary Anderson, both of Lancashire, all of (GB)

(73) Assignee: Coin Controls Limited, Oldham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,758

(22) Filed: Nov. 4, 1998

(30) Foreign Application Priority Data

Mar. 23, 1998 (GB) ..... 9806188

(51) Int. Cl.[7] ..... G07D 3/14
(52) U.S. Cl. ..... 453/3; 453/57
(58) Field of Search ..... 453/3, 4, 7, 9, 453/11, 17, 34, 35, 49, 57

(56) References Cited

U.S. PATENT DOCUMENTS

| | | | | |
|---|---|---|---|---|
| 3,942,543 A | | 3/1976 | Crowell et al. | |
| 4,374,529 A | * | 2/1983 | Kobayashi et al. | 453/17 |
| 4,376,480 A | | 3/1983 | Abe | |
| 4,469,213 A | | 9/1984 | Nicholson et al. | |
| 4,538,719 A | | 9/1985 | Gray et al. | 194/100 |
| 4,570,779 A | | 2/1986 | Abe | 194/318 |
| 4,601,380 A | | 7/1986 | Dean et al. | 194/318 |
| 4,749,074 A | | 6/1988 | Ueki et al. | 194/317 |
| 4,754,862 A | | 7/1988 | Rawicz-Szczerbo et al. | 194/319 |
| 4,798,558 A | | 1/1989 | Bellis | 453/32 |
| 4,845,994 A | | 7/1989 | Quinlan, Jr. | 73/163 |
| 4,951,800 A | | 8/1990 | Yoshihara | 194/317 |
| 4,995,497 A | | 2/1991 | Kai et al. | 194/318 |
| 5,007,520 A | | 4/1991 | Harris et al. | 194/317 |
| 5,033,603 A | | 7/1991 | Kai et al. | 194/334 |
| 5,062,518 A | | 11/1991 | Chitty et al. | 194/317 |
| 5,085,309 A | | 2/1992 | Adamson et al. | 194/317 |
| 5,158,166 A | | 10/1992 | Barson | 194/319 |
| 5,180,046 A | | 1/1993 | Hutton et al. | 194/319 |
| 5,226,520 A | | 7/1993 | Parker | 194/317 |

(List continued on next page.)

FOREIGN PATENT DOCUMENTS

| | | | | |
|---|---|---|---|---|
| EP | 0 155 126 | | 9/1985 | G07F/3/02 |
| EP | 0 164 110 | | 12/1985 | G07F/3/02 |
| EP | 0 384 375 | | 8/1990 | G07F/3/02 |
| EP | 0 404 432 | | 12/1990 | G07F/3/02 |
| EP | 0 155 126 | B1 | 2/1991 | G07F/3/02 |
| EP | 0 164 110 | B1 | 9/1991 | G07F/3/02 |
| EP | 0 384 375 | B1 | 10/1993 | G07F/3/02 |
| EP | 0 404 432 | B1 | 9/1994 | G07F/3/02 |
| GB | 418 423 | * | 11/1934 | |
| GB | 2 065 950 | | 7/1981 | |
| GB | 2 094 008 | A | 9/1982 | G01R/19/045 |
| GB | 2 169 429 | A | 7/1986 | G07D/5/08 |
| GB | 2 200 778 | A | 8/1988 | G07D/5/00 |
| GB | 2 238 152 | A | 5/1991 | G07F/3/02 |
| GB | 2 296 359 | | 6/1996 | |
| JP | 5-3249 85 | * | 12/1993 | 453/3 |
| WO | WO 85/04037 | | 9/1985 | G07F/3/02 |
| WO | WO 98/00816 | | 1/1998 | |

*Primary Examiner*—F. J. Bartuska
(74) *Attorney, Agent, or Firm*—Morgan & Finnegan, LLP

(57) ABSTRACT

A shoebox coin changer has a coin inlet (8) to receive coins a coin acceptor (3) to discriminate between coins from the inlet and a coin sorter (4) to sort coins from the coin acceptor according to denomination. A plurality of coin hoppers (5) receive coins of respective different denominations from the coin sorter, to be paid out selectively by devices (6). The coins are stacked with a random disposition within the hoppers.

19 Claims, 6 Drawing Sheets

U.S. PATENT DOCUMENTS 5,379,876 A 1/1995 Hutton ..... 194/319
5,469,952 A 11/1995 Kershaw et al. ..... 194/317
5,489,015 A 2/1996 Wood ..... 194/318
5,515,960 A 5/1996 Wood ..... 194/328
5,562,536 A * 10/1996 Uchida et al. ..... 453/9
5,577,591 A 11/1996 Abe ..... 194/343
5,657,847 A 8/1997 Tod et al. ..... 194/207
5,662,204 A 9/1997 Menke et al. ..... 194/215
5,964,657 A * 10/1999 Abe et al. ..... 453/57 X
5,989,118 A * 11/1999 Chiba et al. ..... 453/11

* cited by examiner 10
8
3
1
7
C1
C2
C3
11
12
9
13
4
15
14
14'
14''
2
5
5'
5''
6''
6
6'
7
26
26'
26''

COIN CHANGER

FIELD OF THE INVENTION

This invention relates to a coin changer and has particular but not exclusive application to a coin changer for use in a vending machine.

BACKGROUND

Vending machines permit a purchaser to insert a number of coins of different denominations, select a particular purchase and, if the inserted coins are found to be acceptable and of sufficient value, the machine dispenses a purchase. If the purchaser was unable to supply coins corresponding to the exact amount for the purchase and inserts coins to a value exceeding the price of the intending purchase, the vending machine is configured to dispense change, namely coins amounting to the difference between the price of the purchased item and the value of the inserted coins.

Units known in the art as coin changers have been developed to perform both the coin acceptance and change giving. There is no agreed standard size for conventional changers but conventional practice in the industry is to use so-called "shoebox" changers which all have the similar length, width, depth, position of coin entry and exit points, wiring points and fixing locations.

The shoebox changer is designed to be retro-fitted into conventional can vending, glass front vending, cigarette vending and other typical vending machines enabling vending machine manufacturers and operators to purchase changers from different manufacturers and interchange them. The de facto standard dimensions of the shoebox changer fall within a size envelope of height 354±3 mm excluding reject lever (375±6 mm including rejector lever), width 137±3 mm and depth 78±3 mm with 3 retaining support points located at the left, top right and bottom right of a 68±1 mm×114±1 mm matrix for retention with or without adaptor brackets as appropriate.

In normal use, coins enter the shoebox changer via an entry port situated on the top face of the changer. Coins are output from the changer to a cashbox, escrow and or return tray as appropriate through exit ports situated in the base of the changer. A cable or cables are provided, usually on the top face of the changer for connection to the Vending Machine Controller (VMC) which provides access to power and signal connections required for correct operation of the changer.

Conventional shoebox changers all include similar mechanical hardware. A coin acceptor unit is provided at the top of the changer to receive the inserted coins. The acceptor unit determines whether the coins are of an acceptable denomination. If not acceptable, the coins are diverted to a reject path, but otherwise are directed to the coin sorter which sorts the acceptable coins according to their denomination and feeds them to a series of upstanding circular, cylindrical coin tubes for storage purposes or diverts the coins to a cashbox and or escrow. Each coin tube is provided with a payout device.

The changer also includes a control device, usually a microprocessor which is configured to communicate with the VMC via a standard communications protocol. Examples of standard communications protocols include but are not limited to MDB and BDV. The VMC has access to information relating to the value of the selected purchase, together with an input from the changer microprocessor which is indicative of the value of the coins inserted into the changer, allowing the VMC to determine if change needs to, or can be given. If change is to be given, the VMC instructs the changer to pay out an appropriate combination of coins stored in the coin tubes. The VMC can also be programmed to deal with situations which arise due to the non availability of coins of the type required for change.

Although the dimensions of the internal sections of conventional changers are not fixed, there does appear to be an accepted trend to use 147 mm high coin tubes of different internal diameters ranging from 15.0 mm to 33.0 mm to store single stacks of coins of individual denominations respectively, as a column of coins with their major faces overlying one another.

The number of tubes which can be fitted into the changer is restricted by the width and depth dimensions of the shoebox changer envelope. In practice, this allows four or possibly five tubes to be provided, with some restrictions of the tube diameter.

A major problem encountered by vending machine operators is the limitation on the change capacity provided by current coin changers. Hitherto, operators have attempted to circumvent this difficulty by using two coin tubes to store coins of the same denomination, effectively doubling the storage capacity. However, in a four tube changer, this leaves a significantly lower and hence unbalanced capacity for the remaining two stored coin denominations held in the other two tubes. It should be noted that it is generally acknowledged by vending machine operators that three coin or more denominations need only be stored in order to fulfil most vending payout requirements.

Coin hoppers for storing large numbers of coins and providing a payout are well known in the art such as the Compact Hopper, manufactured by the Assignee hereof and described in U.S. Pat. No 4,798,558. Such large hoppers are of dimensions that would not fit within the shoebox changer space envelope. Typically, they are used free standing in a vending machine to receive coins from a coin validator unit that validates input coins, e.g. as described in GB-A-2296359. However, this arrangement has the disadvantage compared with a shoebox changer of being bulky and not configured as a modular unit, so that it is more difficult to maintain and service.

SUMMARY OF THE INVENTION

It is an object of the invention to provide an improved shoebox changer with an improved coin storage capacity.

The present invention provides a shoebox changer, including a plurality of coin hoppers to receive coins of respective individual denominations to be paid out selectively, stacked with a random disposition within the hoppers.

By allowing the coins to be stacked randomly, a much better utilisation of space within the changer envelope can be achieved, so as to increase the storage capacity as compared with corresponding prior art changers within the same changer space envelope.

Another problem with conventional changers is that because change is stored in fixed coin tubes within the body of the changer, they are liable to attack by vandals, particularly at night, and so it would be desirable to easily remove the stored change for certain periods.

Preferably, according to the invention the coin hoppers and the payout devices are formed as a modular unit which can be removed and stored temporarily, e.g. overnight, away from the changer, for reasons of security.

The coin changer according to the invention may include an electrical supply and signal coupling arrangement between the main body and the modular unit for providing an automatic electrical connection to the modular unit when it is mounted on the main body.

Other modular units may be provided, selectively releasable from the main body, which include the coin acceptor, and a power supply unit.

BRIEF DESCRIPTION OF THE DRAWINGS

In order that the invention may be more fully understood, an embodiment thereof will now be described by way of example with reference to the accompanying drawings in which:

FIG. 2 is a schematic block diagram of the circuits of the changer shown in

FIG. 1;

DETAILED DESCRIPTION

Figure 1:
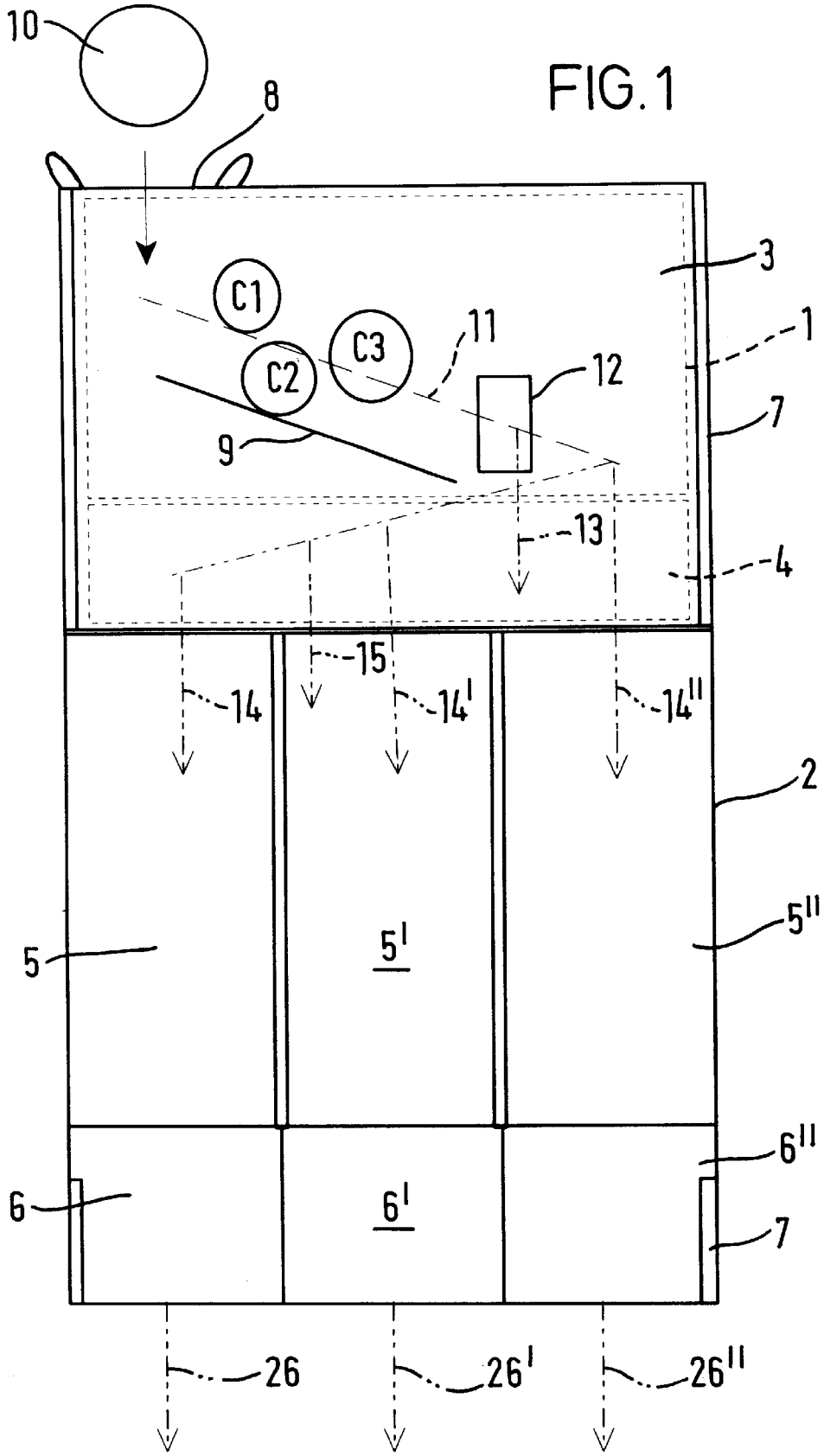
FIG. 1 is a schematic vertical cross section through a coin changer in accordance with the invention.
Figure 3:
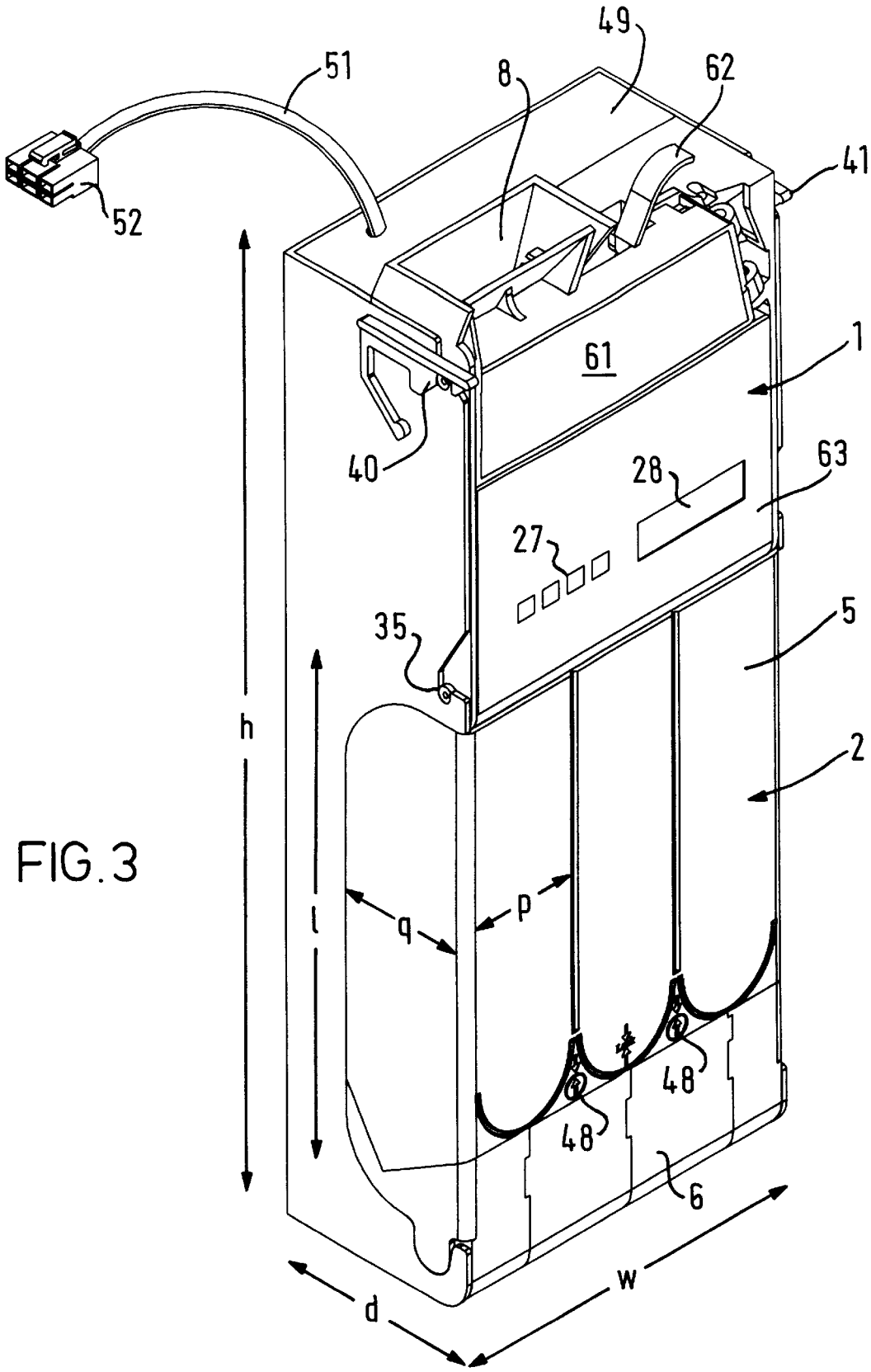
FIG. 3 is a more detailed perspective view of the changer shown in FIG. 1.

Referring to FIG. 1, a shoebox changer in accordance with the invention is shown schematically. The changer consists of a number of modules mounted within the conventional shoebox changer space envelope which has a height dimension h, width w, and a depth d, within the dimensions indicated in the preceding text and as shown in FIG. 3.

The changer is modular in construction and includes two main modules 1, 2. The first module 1 includes a coin acceptor 3 and an associated coin sorter 4, both shown in hatched outline in FIG. 1. The second module 2 includes a plurality of rectangular section coin hoppers 5, 5' and 5" for coins of different denominations. The unit 2 also includes individual electrically driven payout devices 6, 6', 6" for the individual hoppers 5, 5' and 5" respectively. The first and second modules 1, 2 are detachably mounted on the main body 7 as will be described in more detail hereinafter.

Considering the first module 1 in more detail, the coin acceptor 3 can be of any suitable design and the principles of its operation are described in more detail in our GB-A-2 169 429. Alternatively, the acceptor may operate using an array of coils with small diameters as compared with the coins under test, as described in our GB 9804982.8 filed on Mar. 9, 1998. The acceptor 3 includes a coin input opening 8 and a coin rundown path 9 along which a coin 10 under test rolls edgewise along a path 11 shown in dotted line through a coin sensing station that includes three sensing coils C1, C2, C3 that form respective inductive couplings with the coin under test. If the result of the test indicates that the coin is unacceptable, the gate 12 deflects the coin to a reject path 13. However, if the test indicates the coin to be acceptable, the gate 12 is operated so that the coin passes into the sorter 4. The coin acceptor 3 is programmed to accept three different coin denominations which are directed to the coin hoppers 5, 5' and 5" respectively by the sorter 4 along respective paths 14, 14', 14". Accepted coins which are not directed by the sorter 4 into one of the coin hoppers 5, 5' and 5"are directed by the sorter 4 to separate coin path 15 which more usually allows selected coins to be routed to an external cashbox (not shown). The coins are sorted by the sorter 4 according to their mechanical characteristics, i.e. thickness, diameter in a manner known per se. Alternatively, the sorter 4 may include an electromechanical gate operated by the coin acceptor 3.

Figure 2:
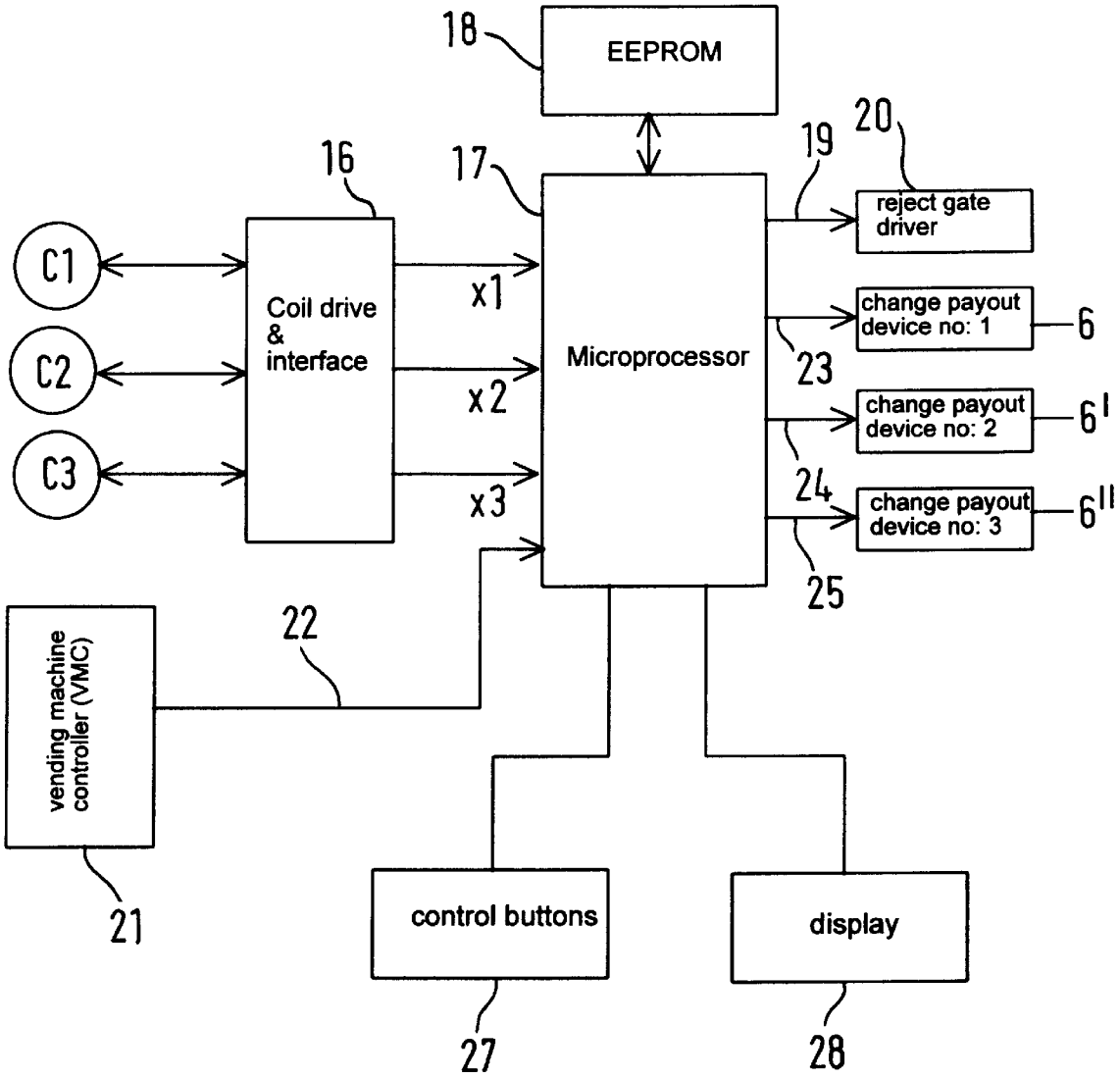

Referring to FIG. 2, the coils C1, C2 and C3 are energised at different frequencies by a drive and interface circuit 16. Eddy currents are induced in the coin under test by the coils. The different inductive couplings between the three coils and the coin characterise the coin substantially uniquely. The drive and interface circuit 16 produces three corresponding coin parameter signals $x_1$, $x_2$, $x_3$ as a function of the different inductive couplings between the coin and the sensing coils C1, C2, C3. These signals may represent the peak amplitude deviation that occurs as the coin passes the respective coil, which may be produced in the manner described in detail in our GB-A-2 169 429 supra.

In order to determine coin authenticity, three coin parameter signals $x_1$, $x_2$, $x_3$ produced by a coin under test are fed to a microprocessor 17, which compares the coin parameter signals with corresponding stored values held in an $E^2$PROM 18. In a well known operation in the art, the stored values are compared in terms of windows with upper and lower limits to accommodate differences from coin to coin. In fact, a series of sets of windows are stored for respective different acceptable coin denominations and the microprocessor compares the coin parameter signals with the different sets of windows to determine whether the coin is of an acceptable denomination.

If the coin is acceptable, an output is applied on line 19 so as to operate a driver circuit 20 which opens the gate 12 to allow the coin to pass to the sorter 4. Otherwise the coin passes to the reject path 13 and is routed in such a way as to exit from the base of the changer via the reject exit port (not shown).

In this instance, the coin acceptor is configured to accept three different coin denominations and the coin is then directed by the sorter 4 to an appropriate one of the coin hoppers 5, 5', 5" along the appropriate path 14, 14' or 14" or routed to the separate path 15 allowing selected coins to be routed to an external cashbox (not shown).

When the coin changer is installed in a vending machine, a cable or cables link the changer to the VMC, which provides the changer with all power and signal connections required for correct operation. In order to make a purchase, the user inserts a number of coins into the vending machine, which pass into the coin acceptor 3 successively, and the coins are validated. The microprocessor 17 therefore accumulates data corresponding to the entered coins. Referring to FIG. 2, VMC 21 accesses this data via cable link 22. The user of the vending machine also operates a purchase selection button (not shown) on the machine, to select a particular item to be purchased. It will be understood that the item has an associated purchase price which is stored in the VMC memory (not shown). The VMC microprocessor makes decisions based on the data received, in particular relating to the value and type of coins input into the changer, the purchase selection price and other relevant information transferred between the changer and the VMC including but not restricted to information relating more specifically to the number of coins stored in each of the coin hoppers 5, 5' and 5".

Provided the accumulated monetary value of the accepted coins exceeds the purchase price for the item concerned, the VMC microprocessor provides an output to a product release mechanism which releases the product to the user.

The purchase price for the item concerned may be less than the accumulated value of the inserted, acceptable coins, in which case change needs to be given. The VMC microprocessor computes the value of change to be dispensed and instructs the changer microprocessor 17 to provide an output on one or more of lines 23, 24 and 25, so as to operate the payout devices 6, 6', 6" selectively. As a result, change is dispensed by the payout devices 6 selectively on paths 26, 26' and 26". For example, the hopper 5 may contain solely 1p coins, the hopper 5' may contain solely 5p coins and the hopper 5" may contain 10p coins, fed to the hopper individually from the coin acceptor 3. The change is thus computed as a particular combination of the three stored coins, which are appropriately paid out by the payout devices 6, 6' and 6". It will however be understood that other coin denominations could be held in the hoppers. For example 5p coins could be held in hoppers 5 and 5' and 20p coins in hopper 5".

The coin changer is programmable in order to allow different coins of a particular currency set to be stored in the coin hoppers 5, 5', and 5" respectively and also to allow coins from different currency sets to be accepted, for use in different markets or to accommodate changeover from one currency set to another e.g. on the introduction of the Euro. Referring to FIG. 2, the programming is carried out by means of control buttons 27 connected to the microprocessor 17 and the display, in the form of a dot matrix liquid crystal display 28 is provided to permit monitoring of the programming steps. Thus by selective operation of the control buttons 27, different sets of window data from the $E^2$PROM 18 can be selected for comparison with the coin signals $x_1$, $x_1$, $x_3$ so as to select the coins that are accepted for the coin hoppers. It will be understood that at the time of manufacture, the $E^2$PROM will be loaded with a large number of window data sets in order to allow selective re-programming in the field. Alternatively, the window data can be updated in the field using equipment (not shown) which is selectively connected to the bus of a microprocessor 17 to download additional sets of window data.

The dot-matrix display 28 may be configured so as to provide instructions to the vending machine operator as a sequence of programming steps selected by operation of the control buttons 27 to enable a simple step-by-step procedure for re-programming of the acceptor in the field. The use of a dot-matrix display 28 allows the language format displayed on the display to be configured in the national language for the currency set being selected.

The detailed physical configuration of the shoebox changer according to the invention will now be described in more detail with reference to FIGS. 3 to 6. As can be seen from FIG. 5, the main body 7 includes a rear panel 30 and depending side panels 31, 32. The side panels include axially aligned slots 33, 34 that receive corresponding lugs 35, 36 on the first modular unit 1, which allows the unit 1 to be hinged into the position shown in FIG. 3. Slots 37, 38 at the top of the side walls 31, 32, receive corresponding lugs 39 (only one shown) on the first modular unit 1, which are held in place by integral spring clips 40, 41, shown in FIG. 3. Thus, the first modular unit 1 can be removed by manually biassing the spring clips 40, 41 upward, slightly lifting the unit 1 and hinging it outwardly of the main body. A locking mechanism (not shown) holds the modular unit 1 in the main body 7.

The second modular unit 2, which comprises the coin hoppers 5 and the payout devices 6, is similarly mounted on the main body 7. The side walls 31, 32 are provided with axially aligned semicircular slots 42, 43 that receive correspondingly shaped lugs 44 (only one shown) on the second modular unit 2 so that it can be hinged into the position shown clearly in FIG. 3. A locking mechanism (not shown) holds the modular unit 2 in the main body 7.

Figure 5:
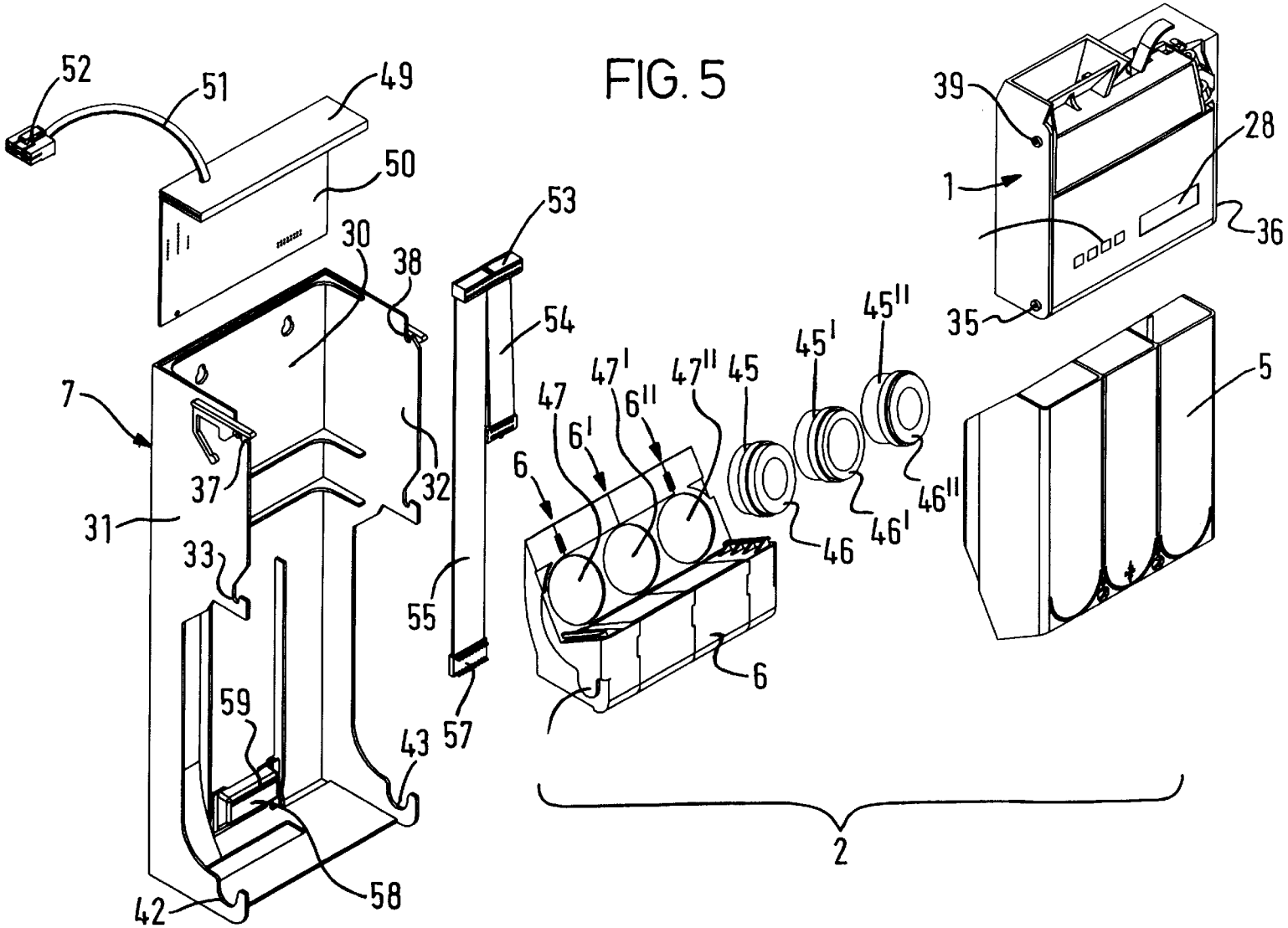
FIG. 5 is an exploded view of the coin changer.
Figure 6A:
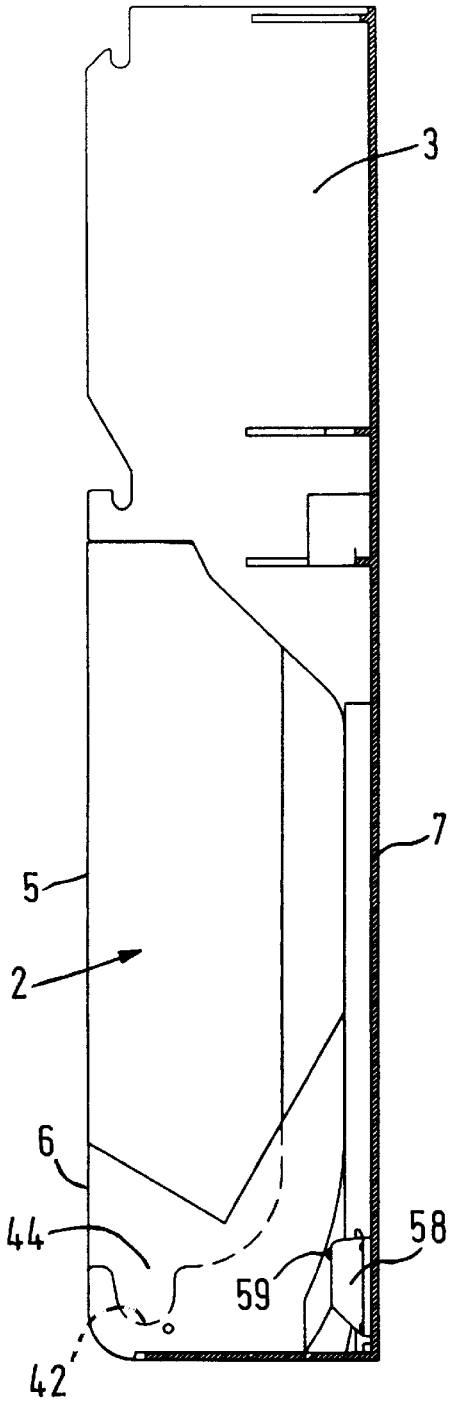
FIGS. 6*a* and 6*b* are sectional views illustrating how the coin hoppers and associated payout devices are configured as a removable, hinged modular unit.
Figure 6B:
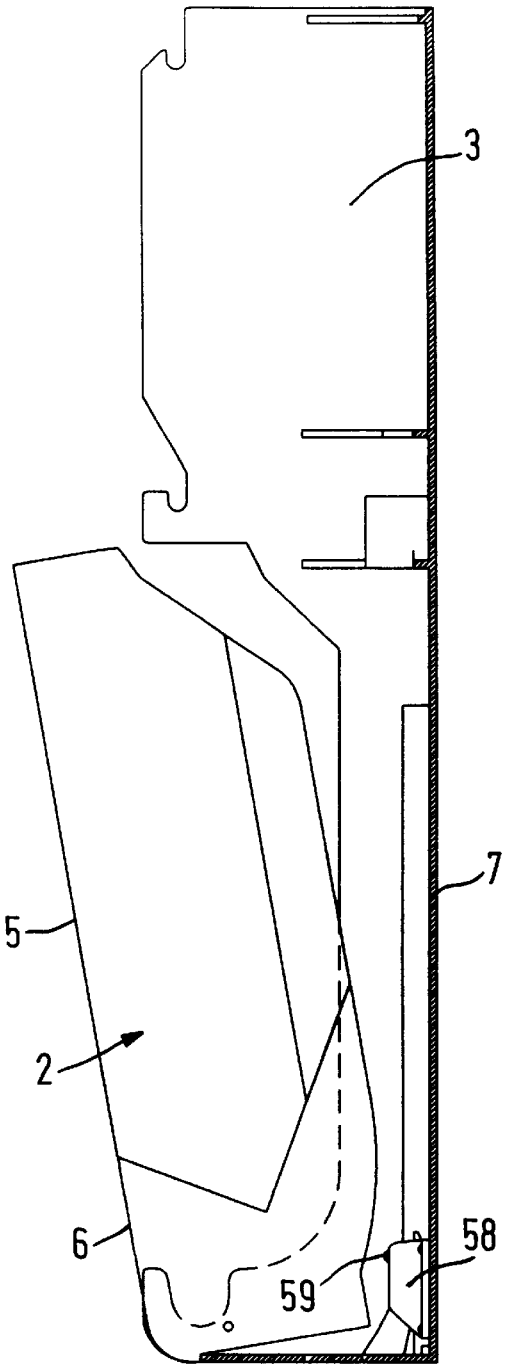

As can be seen from FIG. 5, the coin payout units 6, 6', 6" are mounted in a common housing. Each of the payout devices has a rotary member 45, 45' and 45" with a central aperture and a projection 46, 46' and 46" which, on rotation by an electric actuator (not shown), encourages coins from the respective coin hoppers 5, 5' and 5" into corresponding apertures 47, 47' and 47" that contain respective electrically driven payout devices for paying out individual coins through apertures (not shown) on the underside of the unit 2. The construction and operation of the individual payout devices is described in more detail in our PCT/GB97/01604 (Publication No. WO98/00816).

Figure 4:
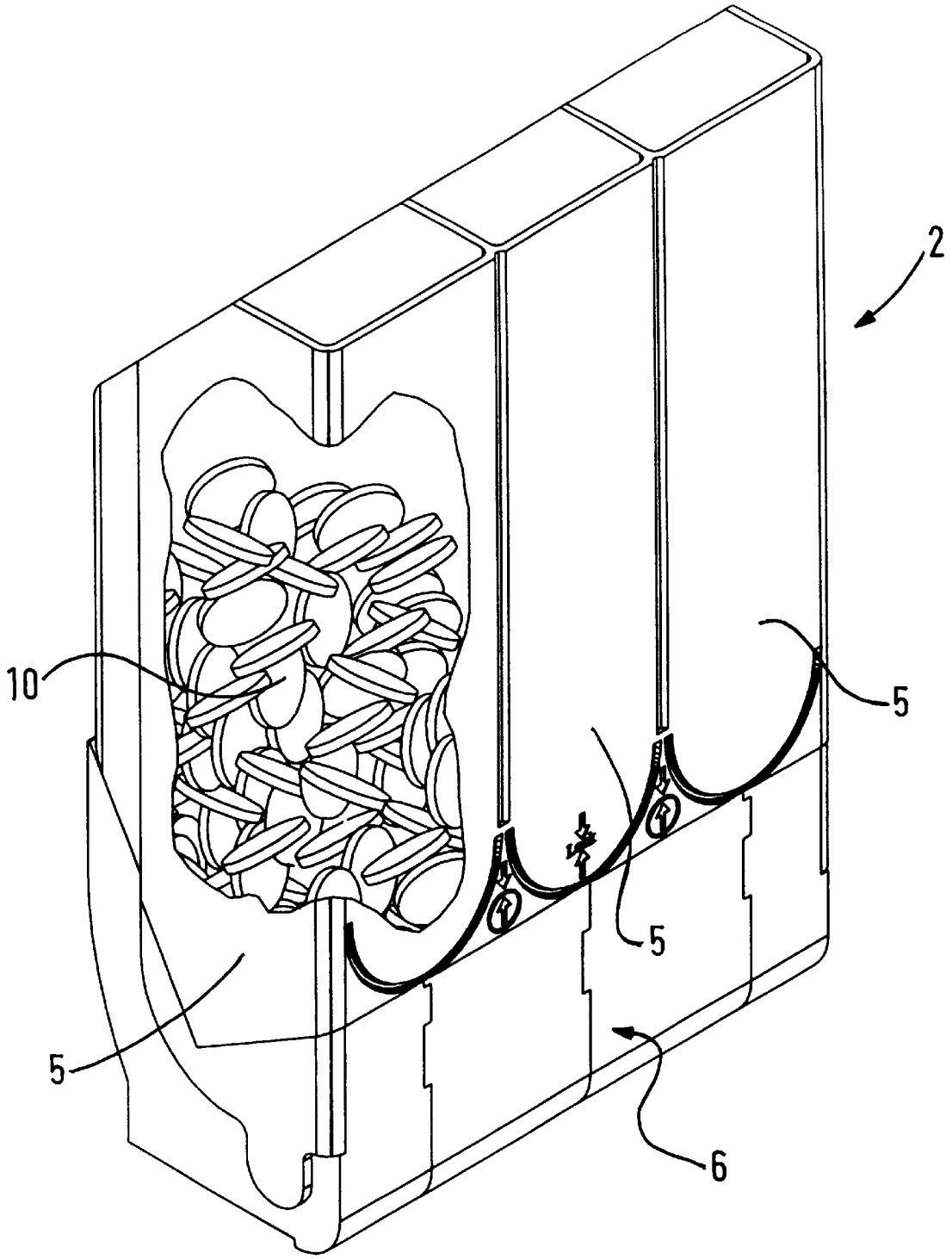
FIG. 4 illustrates the coin hoppers shown in FIG. 3 in more detail, with one of the coin hoppers being shown partially broken away so as to illustrate coins stacked with a random disposition within the hopper.

The coin hoppers 5 are of a rectangular cross section and are integrally moulded in plastics material as a single unit, as can be seen clearly in FIG. 5. The hoppers 5 are releasably locked onto the payout devices 6 by means of a pair of locking screws 48, which can be rotated to lock or unlock the hoppers and the payout devices 6 together (FIG. 3). Each of the coin hoppers 5 has a nominal height l=175 mm, and nominal width p=42 mm and a nominal depth q=65 mm. As shown in FIG. 4, the coins 10 which pass into the hoppers 5 are stacked with a random disposition, in contrast to the face-to-face column of coins produced in conventional cylindrical tubes. As a result, the number of coins which can be stacked in the individual coin hoppers according to the invention is much greater than in the prior art, because the coin hoppers in the described example of a changer according to the invention use 28.5% of the total volume of the shoebox changer to be used for the aforesaid purpose. Stated more generally, the invention permits a percentage volume of the shoebox of at least 18% and, preferably, of at least 20, 22, 24, 26 or 28% to be used for the storage of change. This figure can be compared with the 13.5% percentage volume of a prior art changer fitted with say 4 tubes of diameter 32 mm and height of 147 mm to be used for the purpose of storing coins. It should be noted that in practice the % figure given for prior art changers would be considerably lower than this due to the practical requirement to store coins of diameters considerably smaller than the 32 mm used in the example. The improvement is exemplified in the following Table which compares the storage capabilities of the hoppers for coins of the UK currency set, as compared with a shoebox validator in the prior art, using conventional circular section tubes of 147 mm height.

| | Conventional 147 mm stacked tube | | Embodiment of the invention | | |
|---|---|---|---|---|---|
| | Number of coins | Value | Number of coins | Value | % increase |
| 1 p | 88 | 88 p | 330 | £3.30 | 375 |
| 2 p | 67 | £1.34 | 180 | £3.60 | 269 |
| 5 p | 78 | £3.90 | 420 | £21.00 | 538 |
| 10 p | 74 | £7.40 | 200 | £20.00 | 270 |
| 20 p | 78 | £15.60 | 245 | £49.00 | 314 |

-continued

| | Conventional 147 mm stacked tube | | Embodiment of the invention | | |
|---|---|---|---|---|---|
| | Number of coins | Value | Number of coins | Value | % increase |
| 50 p new | 74 | £37.00 | 155 | £77.50 | 209 |
| £1 | 44 | £44.00 | 165 | £165.00 | 375 |
| £2 | 54 | £108.00 | 95 | £190.00 | 176 |

It will be seen that the number of coins stored is increased substantially in accordance with the invention.

The electrical power supply for the first and second modular units will now be described. A plastics carrier plate 49 retains a power supply module 50 and also an electrical multi-core cable 51 having a plug 52 for connection to but not limited to the vending machine's power supply and communication port (not shown). A ribbon connector 53 shown in FIG. 5 provides connections to two ribbon cables 54, 55 with respective terminating connector 56, 57. The connector 56 plugs into the power supply module 50 allowing regulated power to be distributed to modular units 1 and 2. The connector 53 plugs into the rear of the first modular unit 1 in order to provide electrical power for the coil drive and interface circuits 15, the microprocessor 17 and the $E^2$PROM 18 and the LCD display 28 shown in FIG. 2, which are mounted in the modular unit 1. The cable 55 and connector 57 plug into the rear of an electrical connector 58 mounted on the back plate 30 of the main body 7. The connector 58 is provided with a series of contact pins 59 so that as the second modular unit 2 is hinged into position, electrical contact is made to the rear of the solenoid payout units 6, as can be clearly seen in FIGS. 6*a* and 6*b*. This arrangement has the advantage that the second modular unit 2 can be removed from the main body 7 without the need to manually disconnect and subsequently reconnect electrical wires to the payout devices 6; the electrical connection is made automatically as a result of hinging the modular unit 2 into place on the main body 7.

As a result, the operator of the vending machine can readily remove the second modular unit 2 and store it, together with the coins held in the payout hoppers 5, in a safe overnight in order to minimise the risk of loss due to malicious damage to the vending machine by vandals. The modular unit can thus easily be inserted back into the machine in the morning, in a simple and effective manner.

The first modular unit 1 will now be described in more detail. Referring to FIG. 3, coin acceptor 3 includes a coin door 61 which can be opened to provide access to the coils C1, C2, C3 and also to release a coin jam. A coin release lever 62 is provided in a conventional manner, to open the door partially and allow coin jams to be released.

The control buttons 27 and the display 28 previously described with reference to FIG. 2, are mounted on a panel 63, shown in detail in FIG. 3. The display 28 comprises a back-lit dot matrix LCD display. The buttons 27 allow the owner/installer service engineer of the vending machine to selectively re-program the coin acceptor for use with different coins, as previously explained. It will be understood that the display is only available to the owner of the machine when the vending machine is opened and is not on display to users of the machine.

As used herein, the term "coin" includes other coin like items such as tokens.

What is claimed is:

1. A shoebox coin changer comprising:

a changer frame with a size envelope of the order of height 354±3 mm, width 137±3 mm and depth 78±3 mm;

a payout assembly movably connectable to the frame; and a coin holder assembly detachably connectable to the payout assembly and moveable along with the payout assembly to a closed condition within the envelope, the coin holder assembly having a plurality of coin hoppers to receive coins of respective different denominations to be paid out selectively, stacked with a random disposition within the hopper, wherein the payout assembly is pivotably connectable to the frame.

2. The changer according to claim 1, wherein the payout assembly is detachably connectable to the frame.

3. The changer according to claim 2, wherein the payout assembly comprises rotary valve members, associated with corresponding coin hoppers, for encouraging coins from respective coin hoppers to the payout assembly.

4. The changer according to claim 3, wherein the rotary valve members are adapted to engage coin outlet openings of respective coin hoppers when the coin holder assembly is mounted to the payout assembly.

5. The changer according to claim 1, wherein the payout assembly includes a plurality of individual payout devices for each coin hopper, each individual payout device being arranged immediately adjacent to a corresponding coin hopper to receive coins directly from a corresponding coin hopper.

6. The changer according to claim 1, wherein the plurality of coin hoppers of the coin holder assembly are arranged side-by-side across the width of the envelope.

7. The changer according to claim 1, wherein the coin holder assembly includes a body having one or more partitions for dividing a volume of the body into the plurality of coin hoppers.

8. The changer according to claim 7, wherein the body is a molded, unitary piece.

9. The changer according to claim 1, further comprising:

a coin discriminator assembly, mountable on the frame, for discriminating between coins from a coin inlet and sorting the coins according to denomination.

10. The changer according to claim 9, wherein the coin discriminator assembly, coin holder assembly and payout assembly are modular units configured to fit in the envelope with the coin discriminator assembly being arranged over the coin holder assembly which in turn is arranged over the payout assembly along a height of the envelope.

11. The changer according to claim 9, wherein the coin discriminator includes a display for selectively displaying data concerning the coin denominations directed by the coin discriminator to the coin holder assembly.

12. The changer according to claim 11, wherein the display is operable to display instructions for reprogramming the coin denominations that arc to be directed to the coin holder assembly.

13. The changer according to claim 1, wherein each of the coin hoppers has a substantially rectangular cross-section.

14. The changer according to claim 1, wherein the frame includes an electrical supply coupling arrangement, the coin holder and payout assemblies being configured to automatically connect with the electrical supply coupling arrangement when the coin holder and payout assemblies are moved together to the closed condition within the envelope.

15. The changer according to claim 9, wherein the coin discriminator assembly is pivotably connected to the frame.

16. The changer according to claim 1, wherein the coin holder assembly is configured to be releasably locked onto the payout assembly via one or more rotatable locking screws rotatable to a locked or unlocked condition.

17. The changer according to claim 9, wherein the coin discriminator assembly includes a panel for providing access to an interior of the coin discriminator assembly.

18. The coin changer according to claim 1, wherein the payout assembly further comprises a plurality of rotary valve members, adapted to engage respective coin outlet openings of respective coin hoppers, for encouraging coins from the coin hoppers directly to respective payout devices.

19. A shoebox coin changer comprising:

a changer frame with a size envelope of the order of height 354±3 mm, width 137±3 mm and depth 78±3 mm;

a coin discriminator module, pivotably and detachably connectable to the frame, for discriminating between coins from a coin inlet and sorting the coins according to denomination;

a coin holder module having a unitary, molded body with one or more partitions therein forming a plurality of coin hoppers having a rectangular cross-section to receive coins of respective different denominations to be paid out selectively, stacked with a random disposition within the hopper; and a payout module pivotably and detachably connectable to the frame to receive coins from the coin holder module, the payout assembly having a plurality of individual payout devices arranged immediately adjacent coin outlet openings of respective coin hoppers to receive coins directly therefrom and having a plurality of rotary valve members arranged between respective individual payout devices and respective coin hoppers to encourage coins from a coin hopper to a corresponding payout device;

wherein the coin holder module is detachably connected to the payout module and moveable with the payout module to a closed condition within the envelope, the coin discriminator module, coin holder module and payout module being arrangeable in successive order across the height of the envelope to enable the flow of coins from one module to a successive module.

* * * * *